US011147336B2

(12) United States Patent
Lettow, II et al.

(10) Patent No.: US 11,147,336 B2
(45) Date of Patent: Oct. 19, 2021

(54) PERFORMANCE OUTDOOR FOOTWEAR

(71) Applicant: Vorbeck Materials Corp., Jessup, MD (US)

(72) Inventors: Carl F. Lettow, II, North Arlington, VA (US); Raymond J. Sauro, Columbia, MD (US)

(73) Assignee: VORBECK MATERIALS CORP., Jessup, MD (US)

( * ) Notice: Subject to any disclaimer, the term of this patent is extended or adjusted under 35 U.S.C. 154(b) by 139 days.

(21) Appl. No.: 16/574,283

(22) Filed: Sep. 18, 2019

(65) Prior Publication Data

US 2020/0093216 A1 Mar. 26, 2020

Related U.S. Application Data

(63) Continuation of application No. 14/809,168, filed on Jul. 24, 2015, now abandoned.

(60) Provisional application No. 62/029,352, filed on Jul. 25, 2014.

(51) Int. Cl.

| | |
|---|---|
| ***A43B 5/02*** | (2006.01) |
| ***A43B 1/14*** | (2006.01) |
| ***A43B 13/04*** | (2006.01) |
| ***A43B 23/08*** | (2006.01) |
| ***A43B 1/00*** | (2006.01) |
| ***A43B 13/02*** | (2006.01) |
| ***A43B 23/02*** | (2006.01) |

(52) U.S. Cl.

CPC ..... *A43B 1/14* (2013.01); *A43B 1/00* (2013.01); *A43B 5/02* (2013.01); *A43B 13/026* (2013.01); *A43B 13/04* (2013.01); *A43B 23/0205* (2013.01); *A43B 23/087* (2013.01)

(58) Field of Classification Search

CPC .. A43B 1/00; A43B 5/02; A43B 13/02; A43B 13/026; A43B 23/0205; A43B 23/0225

USPC ..... 36/25 R, 45

See application file for complete search history.

(56) References Cited

U.S. PATENT DOCUMENTS

| | | | | |
|---|---|---|---|---|
| 9,603,416 | B1 * | 3/2017 | Walsh | A01D 7/06 |
| 2006/0062944 | A1 * | 3/2006 | Gardner | F41H 5/0485 428/34.1 |
| 2007/0092432 | A1 * | 4/2007 | Prud'Homme | H05K 1/095 423/448 |
| 2010/0219383 | A1 * | 9/2010 | Eklund | B82Y 30/00 252/516 |
| 2011/0178224 | A1 * | 7/2011 | Pan | C08G 77/16 524/495 |
| 2013/0244019 | A1 * | 9/2013 | Hata | C01B 32/16 428/312.2 |
| 2014/0068880 | A1 * | 3/2014 | Torrance | A43B 5/14 12/146 B |
| 2015/0052778 | A1 * | 2/2015 | Kirk | B32B 5/024 36/45 |

(Continued)

*Primary Examiner* — Marie D Bays

(74) *Attorney, Agent, or Firm* — Trent V. Bolar, Esq.

(57) ABSTRACT

Embodiments of the present invention relate to footwear articles and a method for fabricating a footwear article. The footwear article comprises an upper and a sole that is comprised of a graphene-containing polymer composition and having one or more layers affixed to the upper. The method for fabricating the footwear article comprises forming a sole on an upper. The sole comprises a graphene-containing polymer composition and one or more layers affixed to the upper.

10 Claims, 3 Drawing Sheets

(56) References Cited

U.S. PATENT DOCUMENTS

| | | | | |
|---|---|---|---|---|
| 2015/0208762 | A1* | 7/2015 | Reinhardt | B32B 27/32 36/45 |
| 2015/0210034 | A1* | 7/2015 | Tarrier | B32B 5/04 428/113 |
| 2015/0282544 | A1* | 10/2015 | Lankes | B32B 27/36 428/113 |

* cited by examiner

PERFORMANCE OUTDOOR FOOTWEAR

CROSS-REFERENCE TO RELATED APPLICATIONS

This application is a continuation of U.S. Utility patent application Ser. No. 14/809,168 filed Jul. 24, 2015, which claims priority to U.S. Provisional Application No. 62/029,352 filed Jul. 25, 2014. The applications are hereby incorporated herein by reference.

BACKGROUND

The present invention relates generally to footwear articles and specifically to footwear articles having improved performance. Footwear articles made from polymer compositions containing elastomers are typically used in many areas. Some popular polymers include rubber, hydrogenated nitrile butadiene rubber, nitrile butadiene rubber, ethylene propylene diene monomer rubber, styrene-butadiene rubber. Uses of such materials are typically limited by the structural and/or performance limitations of the polymer compositions. Structural and/or performance limitations are typically addressed by increasing the quantity of the material. In other cases, it may be desirable to replace metal components with polymer compositions. However, such a quantitative increase may not be cost effective or may impact the overall performance of the articles.

DETAILED DESCRIPTION OF THE PREFERRED EMBODIMENTS

Figure 1:
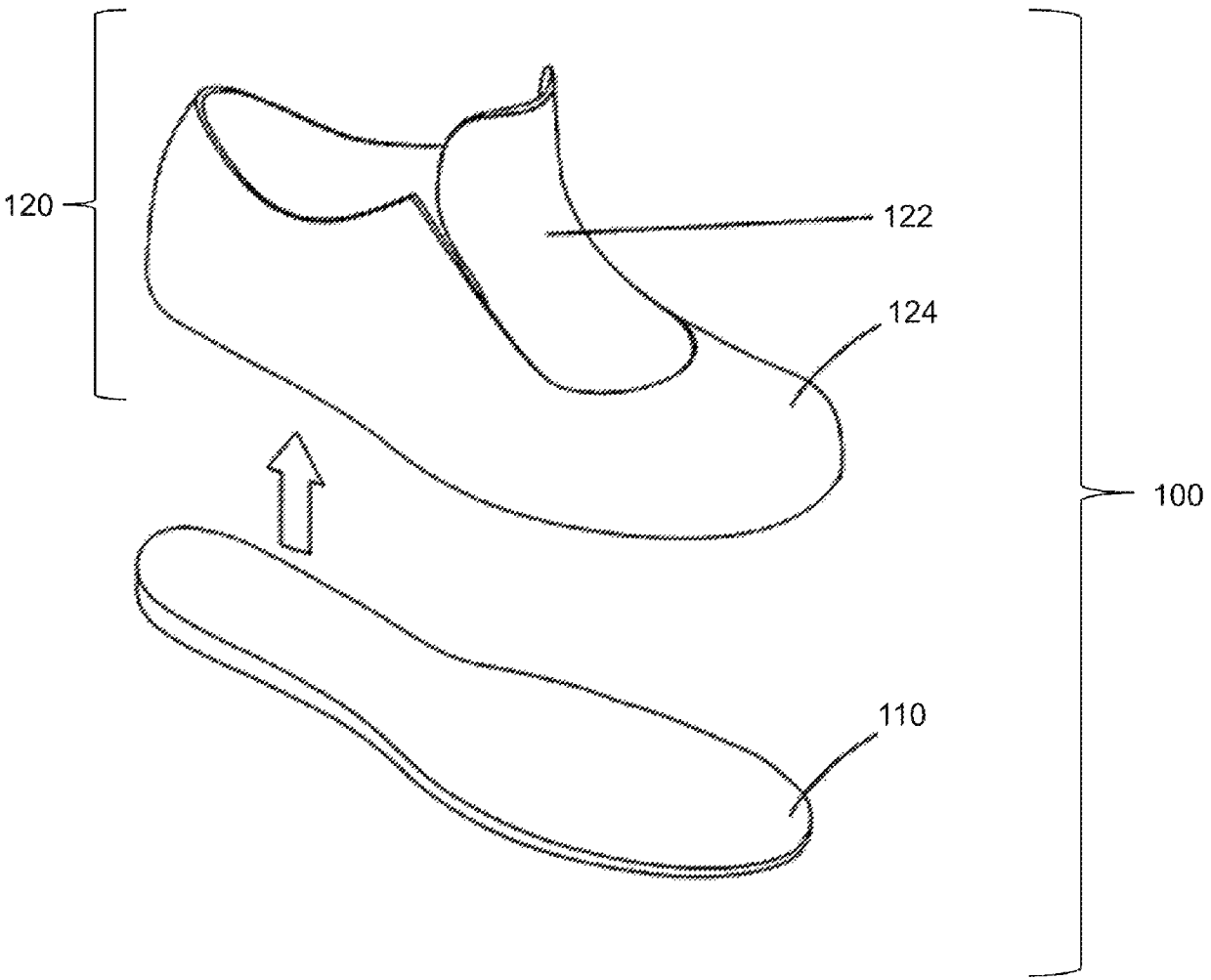
FIG. 1 illustrates a footwear article, generally 100, in accordance with an embodiment of the present invention.

The descriptions of the various embodiments of the present invention are presented for purposes of illustration but are not intended to be exhaustive or limited to the embodiments disclosed. Many modifications and variations will be apparent to those of ordinary skill in the art without departing from the scope and spirit of the described embodiments. The terminology used herein is chosen to best explain the principles of the embodiments, the practical application or technical improvement over technologies found in the marketplace, and/or to enable others of ordinary skill in the art to understand the embodiments disclosed herein.

Embodiments of the present invention relate generally to footwear articles having enhanced structural and/or performance characteristics. Applicable footwear articles (hereinafter "footwear articles") can include an upper having one or more layers and a sole having one or more layers affixed to the upper, wherein the one or more layers of the upper and/or the sole include a graphene composition (hereinafter "the composition"). The composition can include at least one polymer and one or more graphene sheets dispersed in a matrix of the polymer. The compositions may also include additional components (discussed further below).

In certain embodiments, composites containing footwear articles that exhibit enhanced structural and/or performance characteristics. The footwear article can be resistant to abrasion, wherein the relative volume loss in the soles and/or heals is no great than 200 $mm^3$. The sole of the footwear that contact the wearer's foot can achieve a temperature that does not exceed 44° C. The footwear article can have an upper that has a cut resistance of less than 20 mm. The footwear article can have a current leakage of not more than 3.0 mA. The footwear article can have eyelets that have a detachment strength of at least 294N. The footwear article can have a maximum afterflame time of 5.0 seconds or less, does not melt or drip, and does not exhibit any burn-through.

The footwear article can successfully pass the Flex Cracking Resistance Test as described by the American Society for Testing and Materials (hereinafter "ASTM") F 2413 for impact, compression, and puncture resistance. The footwear article can exhibit no melting, separating, or ignition; no water penetration; and all components remain functional. The footwear article can achieve and/or surpass impact, compression and/or puncture resistance as disclosed in the ASTM F 2413 test. The footwear article upper can exhibit no liquid penetration during a one hour submersion duration. The footwear article upper may not puncture under an applied force of 60N and/or as described in ASTM F 1342. The footwear article upper can have a layer that contacts the wearer's foot that does not exceed 44° C.

The footwear article can protect the wearer's foot in a manner wherein the foot can exhibit second degree burn time of no less than 10 seconds and/or have a time to pain of a minimum of six seconds. The footwear article can have an enhanced conductive heat thermal insulation, wherein the temperature of the upper material in contact with the foot does not exceed 44° C. in ten minutes or less. The footwear article can have an enhanced slip resistance, wherein the coefficient of friction of 0.40 or greater. The footwear article can include threads that do not melt below 260° C. The threads can comprise the composition. In an embodiment, the sole, which includes the composition, includes material that provides a coefficient of friction of 0.40 or greater.

The graphene sheets may be made using any suitable method, in accordance with an embodiment of the present invention. For example, the graphene sheets may be obtained from, for example, graphite, graphite oxide, expandable graphite, expanded graphite. The graphene sheets may be obtained by the physical exfoliation of graphite by, for example, peeling, grinding, or milling off graphene sheets. The graphene sheets may be made from inorganic precursors, such as silicon carbide. The graphene sheets may be made by chemical vapor deposition (such as by reacting a methane and hydrogen on a metal surface). The graphene sheets may be made by the reduction of an alcohol, such ethanol, with a metal (such as an alkali metal like sodium) and the subsequent pyrolysis of the alkoxide product, such as disclosed in *Nature Nanotechnology* (2009), 4, 30-33, herein incorporated by reference. The graphene sheets may be made by the exfoliation of graphite in dispersions or exfoliation of graphite oxide in dispersions and the subsequently reducing the exfoliated graphite oxide. The graphene sheets may be made by the exfoliation of expandable graphite, followed by intercalation, and ultrasonication or other means of separating the intercalated sheets as described in *Nature Nanotechnology* (2008), 3, 538-542, herein incorporated by reference. The graphene sheets may be made by the intercalation of graphite and the subsequent exfoliation of the product in suspension or thermally.

The graphene sheets may be made from graphite oxide (also known as graphitic acid or graphene oxide). For example, graphite may be treated with oxidizing and/or intercalating agents and exfoliated. The graphite may also be treated with intercalating agents and electrochemically oxidized and exfoliated. The graphene sheets may be formed by ultrasonically exfoliating suspensions of graphite and/or graphite oxide in a liquid (which may contain surfactants and/or intercalants). Exfoliated graphite oxide dispersions or suspensions can be subsequently reduced to graphene sheets. The graphene sheets may also be formed by mechanical treatment, such as grinding or milling, to exfoliate graphite or graphite oxide, which may subsequently be reduced to graphene sheets.

Reduction of graphite oxide to graphene may be accomplished by means of a chemical reduction, which may be carried out on graphite oxide in a dry form or in a dispersion. Examples of useful chemical reducing agents include, but are not limited to, hydrazines, such as hydrazine, N,N-dimethylhydrazine, sodium borohydride, citric acid, hydroquinone, isocyanates, such as phenyl isocyanate, hydrogen, and hydrogen plasma. A dispersion or suspension of exfoliated graphite oxide in a carrier, such as water, organic solvents, or a mixture of solvents, can be made using any suitable method, such as ultrasonication and/or mechanical grinding or milling, and reduced to graphene sheets, in accordance with an embodiment of the present invention.

Graphite oxide may be produced by any method known in the art, in accordance with an embodiment of the present invention. For example, graphite oxide can result from the oxidation of graphite using one or more chemical oxidizing agents and, optionally, intercalating agents such as sulfuric acid. Examples of applicable oxidizing agents include, but are not limited to, nitric acid, nitrates, such as sodium and potassium nitrates, perchlorates, potassium chlorate, sodium chlorate, chromic acid, potassium chromate, sodium chromate, potassium dichromate, sodium dichromate, hydrogen peroxide, sodium and potassium permanganates, phosphoric acid ($H_3PO_4$), phosphorus pentoxide, and bisulfites. Applicable oxidants include, but are not limited to, $KClO_4$; $HNO_3$ and $KClO_3$; $KMnO_4$ and/or $NaMnO_4$; $KMnO_4$ and $NaNO_3$; $K_2S_2O_8$ and $P_2O_5$ and $KMnO_4$; $KMnO_4$ and $HNO_3$; and $HNO_3$. Applicable intercalation agents include sulfuric acid. Graphite may also be treated with intercalating agents and electrochemically oxidized to produce graphite oxide. Examples of applicable methods of making graphite oxide are also described by Staudenmaier (*Ber. Stsch. Chem. Ges.* (1898), 31, 1481) and Hummers (*J. Am. Chem. Soc.* (1958), 80, 1339), which are both herein incorporated by reference.

An example of a method for the preparation of graphene sheets involves the oxidation of graphite to graphite oxide, and subsequent thermal exfoliation, as described in US 2007/0092432, which is hereby incorporated by reference. The resulting graphene sheets typically display little or no signature corresponding to graphite or graphite oxide in their X-ray diffraction pattern. The thermal exfoliation may be carried out in a continuous or semi-continuous batch process.

The thermal exfoliation heating can be accomplished in a batch process or a continuous process and can be done under a variety of atmospheres, including inert and reducing atmospheres, such as nitrogen, argon, and/or hydrogen atmospheres. Required heating times can range from under a few seconds or several hours or more, depending on the temperatures used and the characteristics desired in the final thermally exfoliated graphite oxide. The heating can be undertaking in any appropriate vessel, such as a fused silica, mineral, metal, carbon, such as graphite, or ceramic vessel. The heating may be accomplished using a flash lamp or with microwaves. For example, during heating, the graphite oxide may be contained in an essentially constant location in single batch reaction vessel, or may be transported through one or more vessels during the reaction in a continuous or batch mode. The heating may be accomplished using any suitable means, including the use of furnaces and infrared heaters, in accordance with an embodiment of the present invention.

Examples of temperatures at which the thermal exfoliation and/or reduction of graphite oxide can be carried out can be at least 150° C., at least 200° C., at least 300° C., at least 400° C., at least 450° C., at least 500° C., at least 600° C., at least 700° C., at least 750° C., at least 800° C., at least 850° C., at least 900° C., at least 950° C., at least 1000° C., at least 1100° C., at least 1500° C., at least 2000° C., and at least 2500° C. Applicable temperature ranges required for the thermal exfoliation and/or reduction include between about 750 about and 3000° C., between about 850 and 2500° C., between about 950 and about 2500° C., between about 950 and about 1500° C., between about 750 about and 3100° C., between about 850 and 2500° C., or between about 950 and about 2500° C.

The time of heating can range from less than a second to a plurality of minutes, for example, less than 0.5 seconds, less than 1 second, less than 5 seconds, less than 10 seconds, less than 20 seconds, less than 30 seconds, or less than 1 min. The time of heating can be at least 1 minute, at least 2 minutes, at least 5 minutes, at least 15 minutes, at least 30 minutes, at least 45 minutes, at least 60 minutes, at least 90 minutes, at least 120 minutes, at least 150 minutes, at least 240 minutes, from 0.01 seconds to 240 minutes, from 0.5 seconds to 240 minutes, from 1 second to 240 minutes, from 1 minute to 240 minutes, from 0.01 seconds to 60 minutes, from 0.5 seconds to 60 minutes, from 1 second to 60 minutes, from 1 minute to 60 minutes, from 0.01 seconds to 10 minutes, from 0.5 seconds to 10 minutes, from 1 second to 10 minutes, from 1 minute to 10 minutes, from 0.01 seconds to 1 minute, from 0.5 seconds to 1 minute, from 1 second to 1 minute, no more than 600 minutes, no more than 450 minutes, no more than 300 minutes, no more than 180 minutes, no more than 120 minutes, no more than 90 minutes, no more than 60 minutes, no more than 30 minutes, no more than 15 minutes, no more than 10 minutes, no more than 5 minutes, no more than 1 minute, no more than 30 seconds, no more than 10 seconds, or no more than 1 second. During the course of heating, the temperature may vary.

Examples of the rate of heating can include at least 120° C./min, at least 200° C./min, at least 300° C./min, at least 400° C./min, at least 600° C./min, at least 800° C./min, at least 1000° C./min, at least 1200° C./min, at least 1500° C./min, at least 1800° C./min, and at least 2000° C./min.

Graphene sheets may be annealed or reduced to graphene sheets having higher carbon to oxygen ratios by heating under reducing atmospheric conditions (e.g., in systems purged with inert gases or hydrogen). The reduction/annealing temperatures can be at least 300° C., or at least 350° C., or at least 400° C., or at least 500° C., or at least 600° C., or at least 750° C., or at least 850° C., or at least 950° C., or at least 1000° C. The reduction/annealing temperature used may be, for example, between about 750 about and 3000° C., or between about 850 and 2500° C., or between about 950 and about 2500° C.

The time of heating for the reduction/annealing can be for example, at least 1 second, or at least 10 second, or at least 1 minute, or at least 2 minutes, or at least 5 minutes. In some embodiments, the heating time for the reduction/annealing is at least 15 minutes, or 30 minutes, or 45 minutes, or 60 minutes, or 90 minutes, or 120 minutes, or 150 minutes.

During the course of annealing/reduction, the temperature may vary within these ranges.

The heating may be done under a variety of conditions, including in an inert atmosphere, such as argon or nitrogen, or a reducing atmosphere, such as hydrogen, including, but not limited to, hydrogen diluted in an inert gas such as argon or nitrogen, or under vacuum. The heating may be done in any appropriate vessel, such as a fused silica or a mineral or ceramic vessel or a metal vessel. The heated materials, including any starting materials and any products or intermediates may be contained in an essentially constant location in single batch reaction vessel, or may be transported through one or more vessels during the reaction in a continuous or batch reaction. Heating may be done using any suitable means, including the use of furnaces and infrared heaters.

The graphene sheets can have a surface area of at least 100 $m^2/g$ to for example, at least 200 $m^2/g$, at least 300 $m^2/g$, at least 350 $m^2/g$, at least 400 $m^2/g$, at least 500 $m^2/g$, at least 600 $m^2/g$, at least 700 $m^2/g$, at least 800 $m^2/g$, at least 900 $m^2/g$, or at least 700 $m^2/g$. The surface area may be 400 to 1100 $m^2/g$. The maximum surface area can be calculated to be 2630 $m^2/g$. The surface area can include all values and subvalues therebetween, including, for example, 400, 500, 600, 700, 800, 900, 1000, 1100, 1200, 1300, 1400, 1500, 1600, 1700, 1800, 1900, 2000, 2100, 2200, 2300, 2400, 2500, and 2630 $m^2/g$.

The graphene sheets can have number average aspect ratios of 100 to 100,000, or of 100 to 50,000, or of 100 to 25,000, or of 100 to 10,000. The aspect ratio is the ratio of the longest dimension of the sheet to the shortest.

The graphene sheets may have a bulk density of 0.01 to at least 200 $kg/m^3$. The bulk density can include all values and subvalues therebetween, including 0.05, 0.1, 0.5, 1, 5, 10, 15, 20, 25, 30, 35, 50, 75, 100, 125, 150, and 175 $kg/m^3$.

The graphene sheets may be functionalized with, for example, oxygen-containing functional groups (including, but not limited to, hydroxyl, carboxyl, and epoxy groups) and typically have an overall carbon to oxygen molar ratio (hereinafter "C/O ratio"), as determined by bulk elemental analysis, of at least 1:1, or at least 3:2. Examples of C/O ratio can include 3:2 to 85:15; 3:2 to 20:1; 3:2 to 30:1; 3:2 to 40:1; 3:2 to 60:1; 3:2 to 80:1; 3:2 to 100:1; 3:2 to 200:1; 3:2 to 500:1; 3:2 to 1000:1; 3:2 to greater than 1000:1; 10:1 to 30:1; 80:1 to 100:1; 20:1 to 100:1; 20:1 to 500:1; 20:1 to 1000:1; 50:1 to 300:1; 50:1 to 500:1; and 50:1 to 1000:1. In some embodiments, the C/O ratio is at least 10:1, or at least 15:1, or at least 20:1, or at least 35:1, or at least 50:1, or at least 75:1, or at least 100:1, or at least 200:1, or at least 300:1, or at least 400:1, or at least 500:1, or at least 750:1, or at least 1000:1; or at least 1500:1, or at least 2000:1. The C/O ratio also can include all values and subvalues between these ranges.

The graphene sheets may contain atomic scale kinks, which may be caused by the presence of lattice defects in, or by chemical functionalization of the two-dimensional hexagonal lattice structure of the graphite basal plane.

The composition may further comprise graphite, including, but not included to, natural, Kish, and synthetic, annealed, pyrolytic, and highly oriented pyrolytic graphites. The ratio by weight of graphite to graphene sheets may be from 2:98 to 98:2, or from 5:95 to 95:5, or from 10:90 to 90:10, or from 20:80 to 80:20, or from 30:70 to 70:30, or from 40:60 to 90:10, or from 50:50 to 85:15, or from 60:40 to 85:15, or from 70:30 to 85:15.

The graphene sheets may comprise two or more graphene powders having different particle size distributions and/or morphologies. The graphite may also comprise two or more graphite powders having different particle size distributions and/or morphologies.

The graphene sheets, and optionally, additional components can be combined with polymers to make composites, including, but not limited to, polymer composites. The graphene sheets and, optionally, additional components can be dispersed in one or more solvents with or without a polymer binder.

The compositions may be applied to a substrate as well as the material after it is applied to the substrate, while it is being applied to the substrate, and both before and after any post-application treatments, such as evaporation, cross-linking, and curing. The components of the compositions may vary during these stages. The compositions may optionally further comprise a polymeric binder.

The graphene sheets and, when present, additional components, can be combined with polymers using any suitable method, including solution/dispersion blending and melt processing using, for example, a single or twin-screw extruder, a blender, a kneader, and a Banbury mixer. The polymers can be used as binders. Applicable polymers include, but are not limited to, thermosets, thermoplastics, and non-melt processible polymers. In an embodiment, polymers can also comprise monomers that can be polymerized before, during, or after the application of the composition to the substrate. Polymeric binders can be cross-linked or otherwise cured after the composition has been applied to the substrate. Examples of applicable polymers include, but are not limited to polyolefins (such as polyethylene, linear low density polyethylene (LLDPE), low density polyethylene (LDPE), high density polyethylene, polypropylene, and olefin copolymers), nitrile butadiene rubbers (NBR), highly saturated nitrile rubbers (HSN), styrene/butadiene rubbers (SBR), styrene/ethylene/butadiene/styrene copolymers (SEBS), butyl rubbers, ethylene/propylene copolymers (EPR), ethylene/propylene/diene monomer copolymers (EPDM), polystyrene (including high impact polystyrene), poly(vinyl acetates), ethylene/vinyl acetate copolymers (EVA), poly(vinyl alcohols), ethylene/vinyl alcohol copolymers (EVOH), poly(vinyl butyral) (PVB), poly(vinyl formal), poly(methyl methacrylate) and other acrylate polymers and copolymers (such as methyl methacrylate polymers, methacrylate copolymers, polymers derived from one or more acrylates, methacrylates, ethyl acrylates, ethyl methacrylates, butyl acrylates, butyl methacrylates, glycidyl acrylates and methacrylates and the like), olefin and styrene copolymers, acrylonitrile/butadiene/styrene (ABS), styrene/acrylonitrile polymers (SAN), styrene/maleic anhydride copolymers, isobutylene/maleic anhydride copolymers, ethylene/acrylic acid copolymers, poly(acrylonitrile), poly(vinyl acetate) and poly(vinyl acetate) copolymers, poly(vinyl pyrrolidone) and poly(vinyl pyrrolidone) copolymers, vinyl acetate and vinyl pyrrolidone copolymers, polycarbonates (PC), polyamides, polyesters, liquid crystalline polymers (LCPs), poly(lactic acid) (PLA), poly (phenylene oxide) (PPO), PPO-polyamide alloys, polysulphone (PSU), polysulfides, polyetherketone (PEK), polyetheretherketone (PEEK), polyimides, polyoxymethylene (POM) homo- and copolymers, polyetherimides, fluorinated ethylene propylene polymers (FEP), poly(vinyl fluoride), poly(vinylidene fluoride), poly(vinylidene chloride), poly(vinyl chloride) (PVC), polyurethanes (thermoplastic and thermosetting (including crosslinked polyurethanes, such as crosslinked amines), aramides (such as Kevlar® and Nomex®), polysulfides, polytetrafluoroethylene (PTFE), polysiloxanes (including, but not limited to, polydimethylenesiloxane, dimethylsiloxane/vinylmethylsiloxane copolymers, and vinyldimethylsiloxane terminated poly(dimethylsiloxane)), elastomers, epoxy polymers (including, but not limited to, crosslinked epoxy polymers, such as those crosslinked with polysulfones and amines), polyureas, alkyds, cellulosic polymers (such as nitrocellulose, ethyl cellulose, ethyl hydroxyethyl cellulose, carboxymethyl cellulose, cellulose acetate, cellulose acetate propionates, and cellulose acetate butyrates), polyethers (such as poly(ethylene oxide), poly(propylene oxide), poly(propylene glycol), and oxide/propylene oxide copolymers), acrylic latex polymers, polyester acrylate oligomers and polymers, polyester diol diacrylate polymers, and vinylidene fluoride/tetrafluoroethylene/propylene (VF2/TFE/P) copolymers, perfluoroelastomers such as tetrafluoroethylene perfluoroelastomers (FFKM), highly fluorinated elastomers (FEPM), perfluoro(alkyl vinyl ethers), perfluoro(methyl vinyl ether) (PMVE), perfluoro(ethyl vinyl ether) (PEVE), perfluoro(propyl vinyl ether) (PPVE), fluoropolymers having one or more repeat units derived from vinylidene fluoride, hexafluoropropylene, tetrafluoroethylene, chlorotrifluoroethylene (CTFE), perfluoro(alkyl vinyl ethers), etc.); polysiloxanes (e.g., (polydimethylenesiloxane, dimethylsiloxane/vinylmethylsiloxane copolymers, vinyldimethylsiloxane terminated poly(dimethylsiloxane)); polyurethanes (thermoplastic and thermosetting (including crosslinked polyurethanes such as those crosslinked amines); epoxy polymers (including crosslinked epoxy polymers such as those crosslinked with polysulfones, amines, etc.); acrylate polymers (such as poly(methyl methacrylate), acrylate polymers and copolymers, methyl methacrylate polymers, methacrylate copolymers, polymers derived from one or more acrylates, methacrylates, ethyl acrylates, ethyl methacrylates, butyl acrylates, butyl methacrylates, glycidyl acrylates and methacrylates), and UV-curable resins.

Examples of applicable elastomers include, but are not limited to, polyurethanes, copolyetheresters, rubbers (including butyl rubbers and natural rubbers), styrene/butadiene copolymers, styrene/ethylene/butadiene/styrene copolymer (SEBS), polyisoprene, ethylene/propylene copolymers (EPR), ethylene/propylene/diene monomer copolymers (EPDM), polysiloxanes, and polyethers (such as poly(ethylene oxide), poly(propylene oxide), and their copolymers).

Examples of applicable polyamides include, but are not limited to, aliphatic polyamides, such as polyamide 4,6; polyamide 6,6; polyamide 6; polyamide 11; polyamide 12; polyamide 6,9; polyamide 6,10; polyamide 6,12; polyamide 10,10; polyamide 10,12; and polyamide 12,12), alicyclic polyamides, and aromatic polyamides (such as poly(m-xylylene adipamide) (polyamide MXD,6)) and polyterephthalamides such as poly(dodecamethylene terephthalamide) (polyamide 12,T), poly(decamethylene terephthalamide) (polyamide 10,T), poly(nonamethylene terephthalamide) (polyamide 9,T), the polyamide of hexamethylene terephthalamide and hexamethylene adipamide, the polyamide of hexamethyleneterephthalamide, and 2-methylpentamethyleneterephthalamide. The polyamides may be polymers and copolymers (i.e., polyamides having at least two different repeat units) having melting points between 120 and 255° C. including, but not limited to, aliphatic copolyamides having a melting point of 230° C. or less, aliphatic copolyamides having a melting point of 210° C. or less, aliphatic copolyamides having a melting point of 200° C. or less, and aliphatic copolyamides having a melting point of 180° C. or less, for example Macromelt® and Versamid®.

Examples of acrylate polymers may include, but are not limited to, those made by the polymerization of one or more acrylic acids (including acrylic acid and methacrylic acid) and their derivatives, such as esters. Other examples of acrylate polymers may include methyl acrylate polymers, methyl methacrylate polymers, and methacrylate copolymers. Additional examples of acrylate polymers may include polymers derived from one or more acrylates, methacrylates, acrylic acid, methacrylic acid, methyl acrylate, methyl methacrylate, ethyl acrylate, ethyl methacrylate, butyl acrylate, butyl methacrylate, glycidyl acrylate, glycidyl methacrylates, 2-ethylhexyl acrylate, 2-ethylhexyl methacrylate, hydroxyethyl acrylate, hydroxyethyl (meth)acrylate, acrylonitrile, and the like. The polymers may comprise repeat units derived from other monomers such as olefins (e.g. ethylene and propylene), vinyl acetates, vinyl alcohols, and vinyl pyrrolidones. Still other examples of acrylate polymers may include partially neutralized acrylate polymers and copolymers (such as ionomer resins).

Examples of applicable polymers can further include Elvacite® polymers supplied by Lucite International, Inc., including Elvacite® 2009, 2010, 2013, 2014, 2016, 2028, 2042, 2045, 2046, 2550, 2552,2614, 2669, 2697, 2776, 2823, 2895, 2927, 3001, 3003, 3004, 4018, 4021, 4026, 4028, 4044, 4059, 4400, 4075, 4060, and 4102. Other polymer families include Bynel® polymers, such as Bynel® 2022 and Joncryl® polymers, such as Joncryl® 678 and 682.

Examples of applicable polyesters include, but are not limited to, poly(butylene terephthalate) (PBT), poly(ethylene terephthalate) (PET), poly(1,3-propylene terephthalate) (PPT), poly(ethylene naphthalate) (PEN), and poly(cyclohexanedimethanol terephthalate) (PCT). In some embodiments, the polymer has an acid number of at least 5, or at least 10, or at least 15, or at least 20. Examples of rubbers and elastomers include styrene/butadiene copolymers (SBR), styrene/ethylene/butadiene/styrene copolymer (SEBS), polyisoprene, ethylene/propylene copolymers (EPR), ethylene/propylene/monomer copolymers (EPM), ethylene/propylene/diene monomer copolymers (EPDM), chlorosulphonated polyethylene (CSM), chlorinated polyethylene (CM), ethylene/vinyl acetate copolymers (EVM), butyl rubber, natural rubber, polybutadiene (Buna CB), chloroprene rubber (CR), halogenated butyl rubber, bromobutyl rubber, chlorobutyl rubber, nitrile rubber (butadiene/acrylonitrile copolymer) (NBR) (Buna N rubber), hydrogenated nitrile rubber (HNBR), carboxylated high-acrylonitrile butadiene rubbers (XNBR), carboxylated HNBR, epichlorohydrin copolymers (ECO), epichlorohydrin terpolymers (GECO), polyacrylic rubber (ACM, ABR), ethylene/acrylate rubber (AEM), polynorbornenes, polysulfide rubbers (e.g. OT and EOT), copolyetheresters, ionomers, polyurethanes, polyether urethanes, polyester urethanes, silicone rubbers and elastomers (such as polysiloxanes (e.g., (polydimethylenesiloxane, dimethylsiloxane/vinylmethylsiloxane copolymers, vinyldimethyl siloxane terminated poly(dimethylsiloxane), etc.), fluorosilicone rubber, fluoromethyl silicone rubber (FMQ), fluorovinyl silicone rubbers (FVMQ), phenylmethyl silicone rubbers (PMQ), vinyl silicone rubbers, etc.), fluoropolymers (such as perfluorocarbon rubbers (FFKM), fluoronated hydrocarbon rubbers (FKM), fluorinated ethylene propylene polymers (FEP), poly(vinyl fluoride), poly(vinylidene fluoride), vinylidene fluoride/hexafluoropropylene copolymers (VF2/HFP), vinylidene fluoride/hexafluoropropylene/tetrafluoroethylene (VF2/HFP/TFE) copolymers, vinylidene fluoride)/vinyl methyl ether/tetrafluoroethylene (VF2/PVME/TFE) copolymers, vinylidene fluoride/hexafluoropropylene/tetrafluoroethylene copolymers (VF2/HPF/TFE), vinylidene fluoride/tetrafluoroethylene/propylene (VF2/TFE/P) copolymers, perfluoroelastomers such as tetrafluoroethylene perfluoroelastomers (FFKM), highly fluorinated elastomers (FEPM), perfluoro(alkyl vinyl ethers), perfluoro(methyl vinyl ether) (PMVE), perfluoro(ethyl vinyl ether) (PEVE), perfluoro(propyl vinyl ether) (PPVE), fluoropolymers having one or more repeat units derived from vinylidene fluoride, hexafluoropropylene, tetrafluoroethylene, chlorotrifluoroethylene (CTFE), perfluoro(alkyl vinyl ethers), etc.), and the like.

In certain embodiments, the glass transition temperature of at least one polymer is no greater than 100° C., 90° C., or no greater than 80° C., or no greater than 70° C., or no greater than 60° C., or no greater than 50° C., or no greater than 40° C.

In other embodiments, a binder can be present relative to graphene sheets and graphite, when used, from 1 to 99 weight percent, or from 1 to 50 weight percent, or from 1 to 30 weight percent, or from 1 to 20 weight percent, or from 5 to 80 weight percent, or from 5 to 60 weight percent, or from 5 to 30 weight percent, or from 15 to 85 weight percent, or from 15 to 60 weight percent, or from 15 to 30 weight percent, or from 25 to 80 weight percent, or from 25 to 50 weight percent, or from 40 to 90 weight percent, or from 50 to 90 weight percent, or from 70 to 95 weight percent, based on the total weight of binder and graphene plus graphite, when present.

Examples of applicable solvents into which the graphene sheets and aromatic compounds can be dispersed include water, distilled or synthetic isoparaffinic hydrocarbons, such as Isopar® and Norpar® and Dowanol®, citrus terpenes and mixtures containing citrus terpenes, such as Purogen®, Electron, and Positron, terpenes and terpene alcohols (including terpineols, including alpha-terpineol), limonene, aliphatic petroleum distillates, alcohols (such as methanol, ethanol, n-propanol, i-propanol, n-butanol, i-butanol, sec-butanol, tert-butanol, pentanols, i-amyl alcohol, hexanols, heptanols, octanols, diacetone alcohol, butyl glycol, etc.), ketones (such as acetone, methyl ethyl ketone, cyclohexanone, i-butyl ketone, 2,6,8,trimethyl-4-nonanone etc.), esters (such as methyl acetate, ethyl acetate, n-propyl acetate, i-propyl acetate, n-butyl acetate, i-butyl acetate, tert-butyl acetate, carbitol acetate), glycol ethers, ester and alcohols (such as 2-(2-ethoxyethoxy)ethanol, propylene glycol monomethyl ether and other propylene glycol ethers; ethylene glycol monobutyl ether, 2-methoxyethyl ether (diglyme), propylene glycol methyl ether (PGME); and other ethylene glycol ethers; ethylene and propylene glycol ether acetates, diethylene glycol monoethyl ether acetate, 1-methoxy-2-propanol acetate (PGMEA); and hexylene glycol, such as Hexasol™, dibasic esters (such as dimethyl succinate, dimethyl glutarate, dimethyl adipate), dimethylsulfoxide (DMSO), 1,3-dimethyl-3,4,5,6-tetrahydro-2(1H)-pyrimidinone (DMPU), imides, amides (such as dimethylformamide (DMF) and dimethylacetamide), cyclic amides (such as N-methylpyrrolidone and 2-pyrrolidone), lactones (such as beta-propiolactone, gamma-valerolactone, delta-valerolactone, gamma-butyrolactone, epsilon-caprolactone), cyclic imides (such as imidazolidinones such as N,N'-dimethylimidazolidinone (1,3-dimethyl-2-imidazolidinone)), aromatic solvents and aromatic solvent mixtures (such as toluene, xylenes, mesitylene, and cumene), petroleum distillates, naphthas (such as VM&P naphtha), and mixtures of two or more of the foregoing and mixtures of one or more of the foregoing with other carriers. Solvents can be, for example, low- or non-VOC solvents, non-hazardous air pollution solvents, and non-halogenated solvents.

The compositions can contain additives such as dispersion aids (including surfactants, emulsifiers, and wetting aids), adhesion promoters, thickening agents (including clays), defoamers and antifoamers, biocides, additional fillers, flow enhancers, stabilizers, crosslinking and curing agents, as well as conductive additives.

Examples of applicable dispersing aids include glycol ethers (such as poly(ethylene oxide), block copolymers derived from ethylene oxide and propylene oxide, such Pluronic®), acetylenic diols (such as 2,5,8,11-tetramethyl-6-dodecyn-5,8-diol ethoxylate and Surfynol® and Dynol®, salts of carboxylic acids (including alkali metal and ammonium salts), and polysiloxanes.

Examples of applicable grinding aids include stearates (such as Al, Ca, Mg, and Zn stearates) and acetylenic diols, such as Surfynol® and Dynol®).

Examples of applicable adhesion promoters include titanium chelates and other titanium compounds such as titanium phosphate complexes (including butyl titanium phosphate), titanate esters, diisopropoxy titanium bis(ethyl-3-oxobutanoate, isopropoxy titanium acetylacetonate, and Vertec.

The compositions may optionally comprise at least one "multi-chain lipid", by which term is meant a naturally-occurring or synthetic lipid having a polar head group and at least two nonpolar tail groups connected thereto. Examples of applicable polar head groups include, but are not limited to, oxygen-, sulfur-, and halogen-containing, phosphates, amides, ammonium groups, amino acids (including α-amino acids), saccharides, polysaccharides, esters (Including glyceryl esters), and zwitterionic groups.

The tail groups may be the same or different. Examples of applicable tail groups include, but are not limited to, alkanes, alkenes, alkynes, and aromatic compounds. The tail groups may be hydrocarbons, functionalized hydrocarbons. The tail groups may be saturated or unsaturated. The tail groups may be linear or branched. The tail groups may be derived from, for example, fatty acids, such as oleic acid, palmitic acid, stearic acid, arachidic acid, erucic acid, arachadonic acid, linoleic acid, linolenic acid, and oleic acid.

Examples of multi-chain lipids include, but are not limited to, lecithin and other phospholipids (such as phosphatidylcholine, phosphoglycerides (including phosphatidylserine, phosphatidylinositol, phosphatidylethanolamine (cephalin), and phosphatidylglycerol) and sphingomyelin); glycolipids (such as glucosyl-cerebroside); saccharolipids; and sphingolipids (such as ceramides, di- and triglycerides, phosphosphingolipids, and glycosphingolipids). The multi-chain lipids may be amphoteric, including zwitterionic.

Examples of thickening agents include, but are not limited to, glycol ethers (such as poly(ethylene oxide), block copolymers derived from ethylene oxide and propylene oxide (such as Pluronic®), long-chain carboxylate salts (such aluminum, calcium, zinc, etc. salts of stearates, oleats, and palmitates), aluminosilicates (such as Minex® and Aerosil® 9200), fumed silica, natural and synthetic zeolites.

Examples of applicable electrically conductive polymers include, but are not limited to, polyacetylene, polyethylene dioxythiophene (PEDOT), poly(styrenesulfonate) (PSS), PEDOT:PSS copolymers, polythiophene and polythiophenes, poly(3-alkylthiophenes), poly(2,5-bis(3-tetradecylthiophen-2-yl)thieno[3,2-b]thiophene) (PBTTT), poly(phenylenevinylene), polypyrene, polycarbazole, polyazulene, polyazepine, polyflurorenes, polynaphthalene, polyisonaphthalene, polyaniline, polypyrrole, poly(phenylene sulfide), polycarbozoles, polyindoles, polyphenylenes, copolymers of one or more of the foregoing, and their derivatives and copolymers. The conductive polymers may be undoped or doped, for example, with boron, phosphorous, and iodine.

The compositions can be formed by blending the graphene sheets and aromatic compounds with at least one solvent and/or binder, and, optionally, other additives. Such blending can be done using one or more of the preceding methods. The compositions may be made using any suitable method, including wet or dry methods and batch, semi-continuous, and continuous methods, in accordance with an embodiment of the present invention. Dispersions, suspensions, solutions, etc. of graphene sheets and one or more aromatic compounds can be made or processed (e.g., milled/ground, blended, dispersed, and suspended) by using suitable mixing, dispersing, and/or compounding techniques.

For example, components of the compositions, such as one or more of the graphene sheets, aromatic compounds, graphite (if used), binders, carriers, and/or other components can be processed (e.g., milled/ground, blended by using suitable mixing, dispersing, and/or compounding techniques and apparatus, including ultrasonic devices, high-shear mixers, ball mills, attrition equipment, sandmills, two-roll mills, three-roll mills, cryogenic grinding crushers, extruders, kneaders, double planetary mixers, triple planetary mixers, high pressure homogenizers, horizontal and vertical wet grinding mills), accordance with an embodiment of the present invention. Applicable processing (including grinding) technologies can be wet or dry and can be continuous or discontinuous. Suitable materials for use as grinding media include, but are not limited to, metals, carbon steel, stainless steel, ceramics, stabilized ceramic media (such as cerium yttrium stabilized zirconium oxide), PTFE, glass, and tungsten carbide. The aforementioned methods can be used to change the particle size and/or morphology of the graphite, graphene sheets, other components, and blends or two or more components.

Components may be processed together or separately and may go through multiple processing (including mixing/blending) stages, each involving one or more components (including blends).

There are no particular limitations to the manner in which the graphene sheets, graphite (if used) and other components may be processed and combined. For example, graphene sheets and/or graphite may be processed into given particle size distributions and/or morphologies separately and then combined for further processing with or without the presence of additional components. Unprocessed graphene sheets and/or graphite may be combined with processed graphene sheets and/or graphite and further processed with or without the presence of additional components. Processed and/or unprocessed graphene sheets and/or processed and/or unprocessed graphite may be combined with other components, such as one or more binders and then combined with processed and/or unprocessed graphene sheets and/or processed and/or unprocessed graphite. Two or more combinations of processed and/or unprocessed graphene sheets and/or processed and/or unprocessed graphite that have been combined with other components may be further combined or processed. Any of the foregoing processing steps can be done in the presence of at least one aromatic compound.

In one embodiment, if a multi-chain lipid is used, it can be added to graphene sheets (and/or graphite if present) before processing.

After blending and/or grinding steps, additional components may be added to the compositions, including, but not limited to, thickeners, viscosity modifiers, and binders. The compositions may also be diluted by the addition of more carrier.

The composition can be applied to a wide variety of applicable substrates, including, but not limited to, flexible and/or stretchable materials, silicones and other elastomers and other polymeric materials, metals (such as aluminum, copper, steel, stainless steel, etc.), adhesives, heat-sealable materials (such as cellulose, biaxially oriented polypropylene (BOPP), poly(lactic acid), polyurethanes, etc.), fabrics (including cloths) and textiles (such as cotton, wool, polyesters, rayon, etc.), clothing, ceramics, silicon surfaces, wood, paper, cardboard, paperboard, cellulose-based materials, glassine, labels, silicon, laminates, corrugated materials, concrete, and brick. The substrates can be in the form of films, papers, and larger three-dimensional objects.

The substrates may have been treated with other materials before the composition are applied. Examples include, but are not limited to, substrates (such as PET) coated with indium tin oxide, and antimony tin oxide. The substrates may be woven, nonwoven, and in mesh form.

The substrates may be paper-based materials, including, but are not limited to, paper, paperboard, cardboard, and glassine. The paper-based materials can be surface treated. Examples of applicable surface treatments include, but are not limited to, coatings, such as polymeric coatings, which can include PET, polyethylene, polypropylene, acetates, and nitrocellulose. Coatings may be adhesives. The paper based materials may be sized.

Examples of applicable polymeric materials include, but are not limited to, those comprising thermoplastics and thermosets, including elastomers and rubbers (including thermoplastics and thermosets), silicones, fluorinated polysiloxanes, natural rubber, butyl rubber, chlorosulfonated polyethylene, chlorinated polyethylene, styrene/butadiene copolymers (SBR), styrene/ethylene/butadiene/stryene copolymers (SEBS), styrene/ethylene/butadiene/stryene copolymers grafted with maleic anhydride, styrene/isoprene/styrene copolymers (SIS), polyisoprene, nitrile rubbers, hydrogenated nitrile rubbers, neoprene, ethylene/propylene copolymers (EPR), ethyl ene/propylene/diene copolymers (EPDM), ethylene/vinyl acetate copolymer (EVA), hexafluoropropylene/vinylidene fluoride/tetrafluoroethylene copolymers, tetrafluoroethylene/propylene copolymers, fluorelastomers, polyesters (such as poly(ethylene terephthalate), poly(butylene terephthalate), poly(ethylene naphthalate), liquid crystalline polyesters, poly(lactic acid)); polystyrene; polyamides (including polyterephthalamides); polyimides (such as Kapton®); aramids (such as Kevlar® and Nomex®); fluoropolymers (such as fluorinated ethylene propylene (FEP), polytetrafluoroethylene (PTFE), poly(vinyl fluoride), poly(vinylidene fluoride)); polyetherimides; poly(vinyl chloride); poly(vinylidene chloride); polyurethanes (such as thermoplastic polyurethanes (TPU); spandex, cellulosic polymers (such as nitrocellulose, cellulose acetate, etc.); styrene/acrylonitriles polymers (SAN); arcrylonitrile/butadiene/styrene polymers (ABS); polycarbonates; polyacrylates; poly(methyl methacrylate); ethylene/vinyl acetate copolymers; thermoset epoxies and polyurethanes; polyolefins (such as polyethylene (including low density polyethylene, high density polyethylene, ultra-high molecular weight polyethylene, etc.), polypropylene (such as biaxially-oriented polypropylene, etc.); and Mylar. The polymeric materials may be non-woven materials, such as Tyvek®. The polymeric materials may be adhesive or adhesive-backed materials, such as adhesive-backed papers or paper substitutes. The polymeric materials may be mineral-based paper substitutes, such as Teslin®. The substrate may be a transparent or translucent or optical material, such as glass, quartz, polymer (such as polycarbonate or poly (meth)acrylates (such as poly(methyl methacrylate).

The compositions may be applied to the substrate using any suitable method, including, but not limited to, painting, pouring, spin casting, solution casting, dip coating, powder coating, by syringe or pipette, spray coating, curtain coating, lamination, co-extrusion, electrospray deposition, ink-jet printing, spin coating, thermal transfer (including laser transfer) methods, doctor blade printing, screen printing, rotary screen printing, gravure printing, lithographic printing, intaglio printing, digital printing, capillary printing, offset printing, electrohydrodynamic (EHD) printing (a method of which is described in WO 2007/053621, which is herein incorporated by reference), microprinting, pad printing, tampon printing, stencil printing, wire rod coating, drawing, flexographic printing, stamping, xerography, microcontact printing, dip pen nanolithography, laser printing, via pen or similar means, in accordance with an embodiment of the present invention. The compositions can be applied in multiple layers.

Subsequent to application to a substrate, the compositions may be cured using any suitable technique, including, but are not limited to, drying and oven-drying (in air or another inert or reactive atmosphere), UV curing, IR curing, drying, crosslinking, thermal curing, laser curing, IR curing, microwave curing or drying, and sintering, in accordance with an embodiment of the present invention.

The cured compositions can have a variety of thicknesses, for example, they can optionally have a thickness of at least 2 nm, or at least 5 nm. In various embodiments, the compositions can optionally have a thickness of 2 nm to 2 mm, 5 nm to 1 mm, 2 nm to 100 nm, 2 nm to 200 nm, 2 nm to 500 nm, 2 nm to 1 micrometer, 5 nm to 200 nm, 5 nm to 500 nm, 5 nm to 1 micrometer, 5 nm to 50 micrometers, 5 nm to 200 micrometers, 10 nm to 200 nm, 50 nm to 500 nm, 50 nm to 1 micrometer, 100 nm to 10 micrometers, 1 micrometer to 2 mm, 1 micrometer to 1 mm, 1 micrometer to 500 micrometers, 1 micrometer to 200 micrometers, 1 micrometer to 100 micrometers, 50 micrometers to 1 mm, 100 micrometers to 2 mm, 100 micrometers to 1 mm, 100 micrometers to 750 micrometers, 100 micrometers to 500 micrometers, 500 micrometers to 2 mm, or 500 micrometers to 1 mm.

When applied to a substrate, the compositions can have a variety of forms, including, but not limited to, films, patterns, and other shapes and forms. The compositions may be covered in whole or in part with additional material, such as overcoatings, varnishes, polymers, and fabrics.

The compositions can be applied to the same substrate in varying thicknesses at different points and can be used to build up three-dimensional structures on the substrate. Such materials could have highly variable and tunable porosities and porosity gradients can be formed. They can be used to form articles having anisotropic thermal conductivities. The compositions can be used to form three-dimensional printed constructs, such as those related to footwear articles.

The compositions, including those in the form of polymer composites, dispersions, and coatings, can be thermally resistive. In some embodiments, the composition can have a thermal conductivity of 0.1 to 50 W/m·K, 0.5 to 30 W/m·K, 0.1 to 0.5 W/m·K, 0.1 to 1 W/m·K, 0.1 to 5 W/m·K, 0.5 to 2 W/m·K, 1 to 5 W/m·K, 0.1 to 0.5 W/m·K, 0.1 to 50 W/m·K, 1 to 30 W/m·K, 1 to 20 W/m·K, 1 to 10 W/m·K, 1 to 5 W/m·K, 2 to 25 W/m·K, 5 to 25 W/m·K, or less than 0.7 W/m·K, less than 1 W/m·K, less than 1.5 W/m·K, less than 3 W/m·K, less than 5 W/m·K, less than 7 W/m·K, less than 10 W/m·K, or less than 15 W/m·K.

Aromatic compounds can be combined with the compositions of the present invention, in accordance with an embodiment of the present invention. Applicable aromatic compounds may comprise two or more aromatic rings that may be fused, bonded directly to each other, and/or bonded using a spacer of one or more atoms. The aromatic rings can be all-carbon based or can contain heteroatoms (heteroaromatics). Examples of applicable rings systems the aromatic compounds can be based on (derivatives of) include, but are not limited to, benzene, naphthalene, anthracene, tetracene, pentacene, phenanthrene, pyrene, pyrene, benzo[a]pyrene, coronene, chryrsene, triphenylene, perylene, corannulene, ovalene, acenaphthylene, fluorine, biphenyl, and bisphenols. Examples of applicable heteroaromatic ring systems the aromatic compounds can be based on include furan, thiophene, pyrrole, pyridine, indole, imidazole, pyrimidine, and purine. The aromatic compounds have a molecular weight of less than 2000, 1000, or 500.

The aromatic ring systems may be functionalized or multifunctional compounds that are substituted with one, two, or more functional groups. In certain embodiments, the functional groups are preferably nucleophilic or electrophilic. In some cases, the functional groups are capable of reacting with hydroxyl groups, carboxylic acids or carboxylic acid derivates, and/or epoxy groups. The functional groups can include, but are not limited to, hydroxyls, hydroperoxy and peroxy groups, carboxylic acids, carboxylic acid salts (e.g. Li, Na, K, Mg, Ca, Zn salts), esters, anhydrides, acid halides (including acid chlorides), aldehydes (e.g. formyl groups), acetals, orthoesters, carbonates, amino groups, amides, imines, imides, azides, cyanates, isocyanates, thiol groups, sulfo, sulfino, thiocyanates, expoxies, and ethers. In some cases, there are one, two, three, four, or more functional groups in the functionalized aromatic compound.

Examples include aromatic compounds of the general formulas:

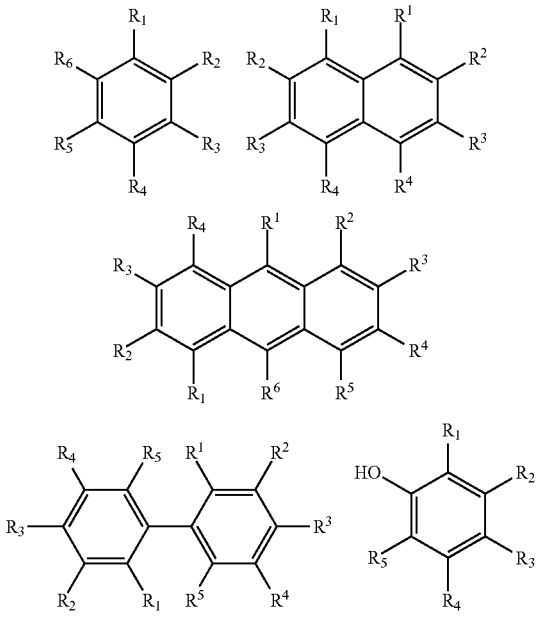

-continued

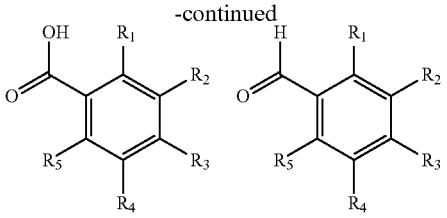

wherein in each case one or more of the substituents present (R1 to R5 and R1 to R6) can be a functional group or be substituted with a functional group. Other substituents can be H, hydrocarbon groups (including, but not limited to, alkyl, alkenyl, alkynyl, aryl, and alicyclic groups), and halides (e.g. chlorides, bromides, iodides, fluorides). The functional groups can be directly bonded to the aromatic ring. In some embodiments, when there are two or more aromatic rings, there can be at least one functional group present on two different rings.

Examples of the aromatic compounds include, but are not limited to, benozoic acid and benzoic acid derivatives, hydroxybenzoic acids (including 4-hydroxybenzoic acid), hydroxybenzaldehydes (including 4-hydroxybenzaldehyde), formylbenzoic acids (including 4-formylbenzoic acid), terephthaldehyde, isophthaldehyde, phthaldialdehyde, terephthalic acid (and esters such as methyl terephthalate, dimethyl terephthalate, etc.), isophthalic acid (and esters such as methyl isophthalate, dimethyl isophthalate, etc.), phthalic acid (and esters such as methyl phthalate, dimethyl phthalate, etc.), phthalic anhydride, bisphenols (such as bisphenol A), biphenyl, 4,4'-biphenol, 3,3'-biphenol, 2,2'-biphenol, 4-hydroxybiphenyl, 3-hydroxybiphenyl, 2-hydroxybiphenyl, naphthalene, hydroxynaphthalenes, dihydroxynaphthalenes (including 2,6-dihydroxynaphthalene, 1,5-dihydroxynaphthalene, 2,3-dihydroxynaphthalene, 1,7-dihydroxynaphthalene, 1,4-dihydroxynaphthalene, 1,2-dihydroxynaphthalene, 1,3-dihydroxynaphthalene, 2,7-dihydroxynaphthalene, and 1,6-dihydroxynaphthalene), naphthalenecarboxylic acids, naphthalenecarboxylic acid esters, naphthalenedicarboxylic acids, naphthalenedicarboxylic acid esters, anthracene, pyrene, pentacene phenol, hydroquinone, catechol, and resorcinol.

In some embodiments, the aromatic compounds can be present relative to graphene sheets in weight ratios from 0.1:99.9 to 75:25, 0.5:99.5 to 75:25, 0.5:99.5 to 50:50, 0.5:99.5 to 25:75, 0.5:99.5 to 15:85, 0.5:99.5 to 10:90, 0.5:99.5 to 5:95, 1:99 to 75:25, 1:99 to 50:50, 1:99 to 25:75, 1:99 to 15:85, 1:99 to 10:90, 1:99 to 5:95, 2:98 to 75:25, 2:98 to 50:50, 2:98 to 25:75, 2:98 to 15:85, 2:98 to 10:90, 2:98 to 5:95, 5:95 to 50:50, 5:95 to 25:75, 10:90 to 75:25, 10:90 to 50:50, or 10:90 to 25:75.

In some embodiments, the aromatic compounds may react with the graphene sheets and/or any polymeric binder that is present. For example, the aromatic compound can serve to crosslink the graphene sheets to themselves and/or to the binder and/or crosslink the polymeric binder to itself. The compositions can have improved mechanical properties, such as improved those listed above.

The composition may further comprise one or more acid catalysts. Applicable acids include organic acids or mineral acids. The $pK_a$ in water of the acid can be less than 4, less than 3, or less than 2.5. The $pK_a$ in water may be less than 2, less than 1, or less than 0. The acids may be in a blocked form, wherein the $pK_a$ is based on the unblocked acid. The acid may be a curing catalyst.

Examples of applicable mineral acids can include, but are not limited to, sulfuric acid, hydrochloric acid, nitric acid, nitrous acid, phosphoric acid, boric acid, hydrobromic acid, and perchloric acid.

Examples of applicable acids include, but are not limited to, sulfur-based acids such as sulfonic acids, polysulfonic acids, for example, disulfonic acids, sulfinic acids, including monomeric and polymeric organic sulfonic acids, such as aromatic sulfonic acids, for example, benzenesulfonic acids, alkylbenzene sulfonic acids, alkyl and aliphatic sulfonic acids, toluenesulfonic acids, and naphthalenesulfonic acids. Examples of applicable sulfonic acids include, but are not limited to, p-toluenesulfonic acid, benzenesulfonic acid, cresol sulfonic acid, 4-ethylbenzenesulfonic acid, xylenesulfonic acid, dimethylbenzenesulfonic acid, pehnolsulfonic acid, dinonylnaphthalenesulfonic acid (DNNSA), dinonylnaphthalenedisulfonic acid (DNNDSA), dodecylbenzenesulfonic acid (DDBSA), and methanesulfonic acid. Examples of applicable acids can also include sulfonic acid resins, such as poly(stryenesulfonic acid), sulfonated fluoropolymers, such as sulfonated tetrafluoroethylene (e.g., Nafion®).

The acids may be phosphorous-based acids, such as phosphoric acid and its derivatives, phosphorous acid and its derivatives, organic phosphorous and phosphate-based acids, such as alkyl and dialkyl acid phosphates. Examples of applicable phosphorous-based acids can also include amyl acid phosphate, diamyl acid phosphate, butyl acid phosphate, dibutyl acid phosphate, ethyl acid phosphate, diethyl acid phosphate, octyl acid phosphate, and dioctyl acid phosphate. The phosphorous-based acids may be metal salts of phosphorous-based acids, such as metal salts of phosphoric acid and phosphoric acid esters.

In some embodiments, the acids can be present in the compositions in 5 to 95 weight percent, 10 to 90 weight percent, 10 to 70 weight percent, 20 to 70 weight percent, 30 to 70 weight percent, or 40 to 60 weight percent, based on the total weight of the acid and aromatic compound.

Figure 2:
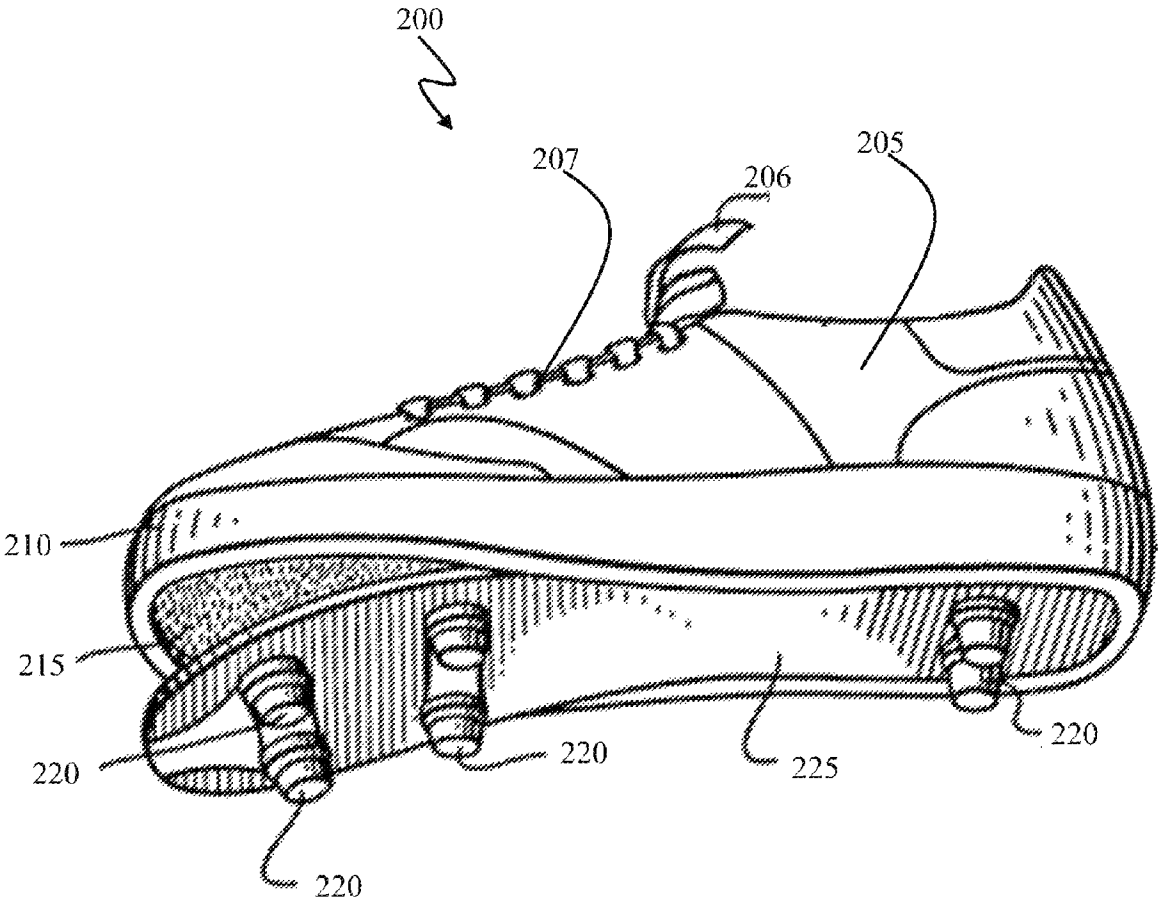
FIG. 2 illustrates a footwear article, generally 200, in accordance with an embodiment of the present invention.
Figure 3:
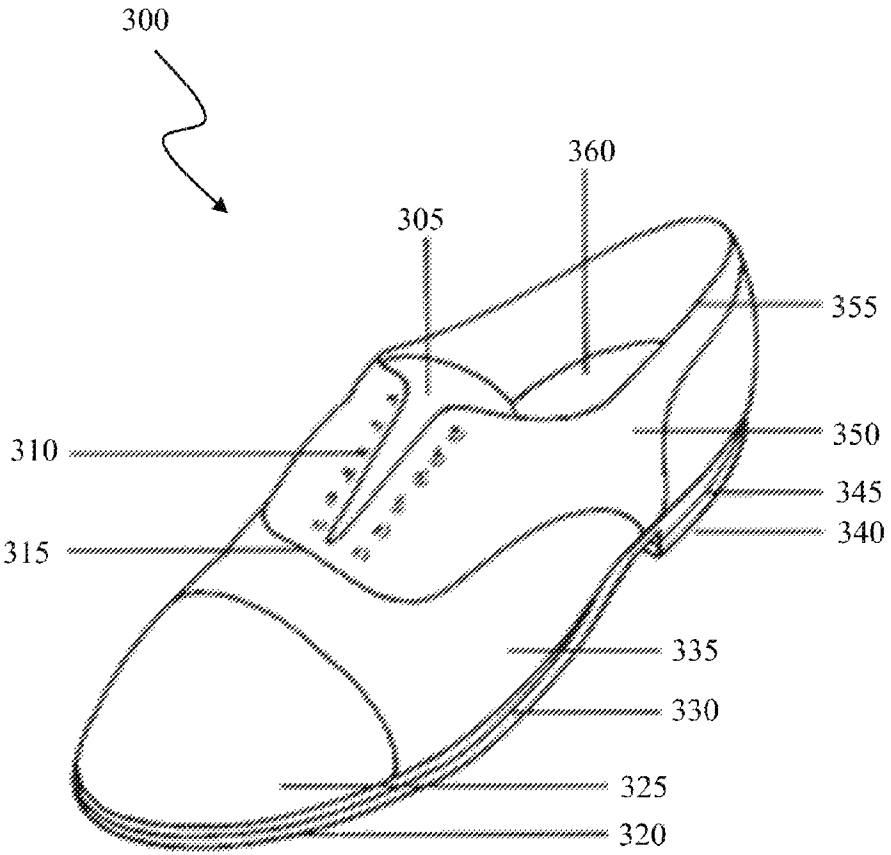
FIG. 3 illustrates a footwear article, generally 300, in accordance with an embodiment of the present invention.

Turning to the drawings, FIGS. 1 through 3 to illustrate non-limiting embodiments of the present invention. Although not shown embodiments depicted in FIGS. 1 through 3 may include additional or less components that depicted. FIG. 1 depicts a footwear article, generally, 100, in accordance with an embodiment of the present invention. Applicable footwear articles, such as footwear article 100, (hereinafter "the footwear article") are garments that can be worn on a foot for various reasons, such as fashion, protection against the environment, and adornment. The footwear article can be, for example, a ballet shoe, a type of boot, a gaiter, a sandal, a type of shoe, a type of sneaker, a clog, an espadrille, a flip-flop, neoprene footwear, and safety footwear. Applicable footwear articles can include snowboard boots, ski boots, ski touring boots, climbing shoes and boots, mountaineering shoes and boots, athletic cleats, trekking shoes and boots, as well as water sandals. In general, footwear articles can be any garment worn on the feet, for fashion, protection against the environment, and/or adornment, in accordance with an embodiment of the present invention. For example, the footwear article can be a rock climbing shoe that exhibits improved traction on surfaces, such as climbing walls and rock surfaces. In an embodiment, the footwear article includes an upper and a sole.

The upper is the part of the footwear article is positioned above the sole. The upper can include a tongue and/or padding around the collar. The upper can also include one or more layers of one or more different types of material, for example, the composition, rubber, plastic, leather, fur, textiles, including felt and non-wovens, plaiting materials, wood, cork, as well as the aforementioned substrates. The upper can also include ankle patches, edging, ornamentation, as well as buckles, tabs, eyelets, stays, and similar attachments. The upper can further include one or more of a collar, an eyelet, an eyestay, a toe cap, a tongue, a vamp, a throat line, and one or more quarters.

The collar is the area that forms the rim of the upper. Eyelets are reinforcements around the edge of a lace hole, usually made of metal or plastic. The eye stay is the area of the footwear on which the eyelets are located. The toe cap is located in the front of the upper and can take various forms, for example, complete replacement for the front upper of the footwear article; stitched over to provide an extra layer to the upper; solid for protection, such as for safety. The tongue is a flap of upper material attached to the vamp that covers the instep of the wearer. The vamp is the part of the upper positioned behind the toe cap and may include the toe if the footwear article has no toe cap. The throat line is an opening of the footwear article extending from the vamp to the ankle. The quarter is the side of the footwear article that extends from the heel to the toe region.

The sole is the part of the footwear article that sit proximately below the wearer's foot. The sole can include an outsole, which is the portion of the sole that comes into contact with the ground. In certain embodiments, the sole can also include a heel, a welt, and/or an insole. The heel is the part of the sole that raises the rear of the sole that raises the rear of the footwear in relation to the front. The welt is material that joins the upper to the sole. The insole is a layer of material that sits inside the footwear article that creates a layer between the sole and the wearer's foot and may provide comfort.

In certain embodiments, incorporation of the composition in the sole and/or upper of the footwear article provides one or more of following characteristics compared to a material of similar weight and/or dimensions that does not include graphene: an increased coefficient of friction; an increased tensile strength; an increased tear strength; an increase strength at temperature; an increased modulus; an improved temperature resistance; and an improved impact resistance compared to a similar elastomer of similar weight and/or dimension.

Article 100 includes upper 120 and sole 110 affixed to upper 120. Sole 110 and/or upper 120 may include the composition. Sole 110 and/or upper 120 may include one or more layers that include the composition. Sole 110 may be substantially affixed to the bottom region of upper 120 proximately beneath the wearer's foot. Sole 110 may include a plurality of layers, regions, and/or portions. Sole 110 may be partially or substantially affixed to one or more side and/or top regions of upper 120. In an embodiment, sole 110 also includes a heel formed substantially near the rear portion of article 100 in relation to the front, a region formed in a manner to contact upper 120, and another region that functions as a ground/surface contact. Toe region 124 can include material comprised of the composition for structural reinforcement and/or added protection. Although not shown, upper 120 can include a securing element to further fit the foot to footwear article 100, such as shoe strings, eyelets, and/or straps. In an embodiment, use of the composition in sole 110 can allow for less material to be used to provide the same or enhanced performance qualities.

Sole 110 can include an outsole region, which contacts the ground and may provide grip, durability, thermal resistance, puncture resistance, radiant heat resistance, slip resistance, conductive heat resistance, and/or liquid resistance. Although not shown, sole 110 may also include an attachment region that is compatible with bike pedals. Sole 110 may be formed in a manner to mimic the contours of the wearer's foot.

In an embodiment, upper 120 does not provide coverage for the whole foot and/or may provide coverage for certain regions of the wearer's foot to make the article functional.

FIG. 2 depicts a footwear article, generally, 200, in accordance with an embodiment of the present invention. Footwear article 200 includes upper 205 and sole 210, either of which may include the composition. In an embodiment, footwear 200 is a cleated footwear article, which includes, but is not limited to, cleated footwear articles utilized in a sporting event, such as golf, soccer, baseball, cricket, football, and field hockey. Upper 205 includes shoelace 206, which are strung through eyelets 207. Sole 210 includes insole 215 and outsole 225, which has a formation of cleat protrusions 220 formed thereon. Insole 210, outsole 225, and/or cleat protrusions 220 may include the composition. Cleat protrusion 220 may be removable. Although not shown, cleat protrusions 220 may each include a removable over fitting sheath comprised of the composition.

Use of the sheath can allow footwear article 200 to be utilized in situations wherein metal cleat protrusions are not allowed as well as in situations where metal cleats are allows and not force the wearer to purchase additional footwear for each situations. Here, use of the composition in footwear article 200 can result in a lighter athletic shoe or in cleat protrusions that are more durable compared to cleat protrusions that do not include the composition.

FIG. 3 depicts a footwear article, generally 300, in accordance with an embodiment of the present invention. Although illustrated as a shoe, footwear article 300 can be any footwear article, such as a boot. Footwear article 300 includes upper 335 and sole 320, which is affixed to upper 335. Upper 335 includes throat line 315, eyelets 310, tongue 305, collar 355, and quarter 350 any of which can include the composition. Sole 320 includes toe cap 325, welt 330, heel 345, and 340 top piece any of which can include the composition. In an embodiment, toe cap 325 includes one or more layers comprised of the composition and provides added protection to the wearer's toes. In certain embodiments, use of the composition in upper 335 and/or sole 320 provides added protection to the wearer's foot. In an embodiment, footwear article 300 is a safety footwear article that provides puncture, thermal, and/or impact protection.

Embodiments of the present invention disclose footwear articles and a related fabrication method. The footwear articles may comprise an upper and a sole that may be comprised of a graphene-containing composition and can have one or more layers affixed to the upper. The graphene-containing polymer composition may include graphene sheets. The graphene sheets may have a surface area of at least 100 $m^2/g$. The upper can include a graphene-containing polymer composition. The upper and a layer included in the one or more layers may comprise a single continuous unit. The graphene-containing polymer composition can have one or more of the following characteristics: a coefficient of friction of 0.40 or greater; a tensile strength of 50 lbs per square inch or greater; a thermal insulation value of at least 0.12 clo; a coefficient of friction of at least 0.75 when dry; and a coefficient of friction of at least 0.5 when wet.

The sole may further comprises a formation of one or more cleat protrusions included on a surface of the sole. The upper can include a graphene-containing polymer composition. The upper may include a toe cap comprised of a graphene-containing polymer composition. The one or more cleat protrusions can be removable and/or include a graphene-containing polymer composition. The method for fabricating a footwear article may comprise forming a sole on an upper, wherein the sole can comprise a graphene-containing polymer composition and one or more layers affixed to the upper. The method can utilize the graphene-containing polymer composition described above.

What is claimed is:

1. A footwear article comprising:
an upper; and
a sole positioned proximate to the upper;
wherein
the upper comprises an eyelet;
the sole comprises:
a formation of cleat protrusions;
a toe cap;
a layer affixed to the upper;
the layer comprises a first polymer composition;
the toe cap comprises a second polymer composition;
the first polymer composition, the second polymer composition, and the third polymer composition each comprise graphene sheets;
the graphene sheets comprise a X-ray pattern displaying no signature corresponding to graphite or graphite oxide; and
the cleat protrusions are removable and comprise a third polymer composition.

2. The footwear article of claim 1, wherein the graphene sheets comprise a surface area of at least 100 $m^2/g$.

3. The footwear article of claim 1, wherein
the upper comprises a fourth polymer composition;
the third polymer composition comprises the graphene sheets; and
the graphene sheets.

4. The footwear article of claim 1, wherein the upper and the layer together form a single continuous unit.

5. The footwear article of claim 1, wherein the first polymer composition, the second polymer composition, and the third polymer composition each comprise one or more of the following characteristics:
a tensile strength of 50 lbs. or greater;
a thermal insulation value of at least 0.12 clo;
a coefficient of friction of at least 0.75 when dry; and
a coefficient of friction of at least 0.5 when wet.

6. The footwear article of claim 3, wherein the upper resists puncture under an applied force of 60N or less as conducted under Active Standard ASTM F1342.

7. A footwear article comprising:
an upper;
a sole positioned proximate to the upper;
wherein
the sole comprises:
a formation of cleat protrusions;
a toe cap;
a layer affixed to the upper;
the cleat protrusions are removable;
the upper comprises an eyelet;
the layer comprises a first polymer composition;
the toe cap comprises a second polymer composition;
the upper comprises a third polymer composition; and
the cleat protrusions comprise a fourth polymer composition,
the first polymer composition, the second polymer composition, the third polymer composition, and the fourth polymer composition each comprise graphene sheets;
the graphene sheets comprise a X-ray pattern displaying no signature corresponding to graphite or graphite oxide;
the first polymer composition, the second polymer composition, and the third polymer composition each comprise one or more of the following characteristics:
a tensile strength of 50 lbs. or greater;
a thermal insulation value of at least 0.12 clo;
a coefficient of friction of at least 0.75 when dry; and
a coefficient of friction of at least 0.5 when wet.

8. The footwear article of claim 7, wherein the graphene sheets comprise a surface area of at least 100 $m^2/g$.

9. The footwear article of claim 7, wherein the upper and the layer together form a single continuous unit.

10. The footwear article of claim 7, wherein the upper resists puncture under an applied force of 60N or less as conducted under Active Standard ASTM F1342.

* * * * *